US009162467B2

(12) United States Patent
Marceddu et al.

(10) Patent No.: US 9,162,467 B2
(45) Date of Patent: Oct. 20, 2015

(54) INK CARTRIDGE FOR INKJET PRINTERS

(75) Inventors: Constanze Marceddu, Stuttgart (DE); Uwe Wiesebrock, Grafenau (DE); Ulrich Zech, Oberriexingen (DE)

(73) Assignee: Marabu GmbH & Co. KG, Tamm (DE)

( * ) Notice: Subject to any disclaimer, the term of this patent is extended or adjusted under 35 U.S.C. 154(b) by 70 days.

(21) Appl. No.: 13/997,346

(22) PCT Filed: Dec. 23, 2011

(86) PCT No.: PCT/EP2011/073950

§ 371 (c)(1),
(2), (4) Date: Jan. 10, 2014

(87) PCT Pub. No.: WO2012/085269

PCT Pub. Date: Jun. 28, 2012

(65) Prior Publication Data

US 2014/0111583 A1 Apr. 24, 2014

(30) Foreign Application Priority Data

Dec. 23, 2010 (DE) ..... 10 2010 055 783

(51) Int. Cl.
*B41J 2/175* (2006.01)

(52) U.S. Cl.
CPC ..... *B41J 2/1752* (2013.01); *B41J 2/17523* (2013.01); *B41J 2/17553* (2013.01)

(58) Field of Classification Search
CPC ... B41J 2/1752; B41J 2/17523; B41J 2/17553
USPC ..... 347/86
See application file for complete search history.

(56) References Cited

U.S. PATENT DOCUMENTS

| | | | | |
|---|---|---|---|---|
| 5,221,935 | A * | 6/1993 | Uzita | 347/36 |
| 5,307,091 | A | 4/1994 | DeCoste, Jr. | |
| 5,666,146 | A | 9/1997 | Mochizuki et al. | |
| 6,219,933 | B1 | 4/2001 | Taniguchi et al. | |
| 6,402,308 | B1 | 6/2002 | Hattori et al. | |
| 6,505,926 | B1 * | 1/2003 | Trafton et al. | 347/86 |
| 7,093,710 | B2 * | 8/2006 | Shimizu et al. | 206/213.1 |

(Continued)

FOREIGN PATENT DOCUMENTS

| | | |
|---|---|---|
| JP | 6-211273 | 8/1994 |
| JP | 6211273 | 8/1994 |

OTHER PUBLICATIONS

International Search report Jun. 25, 2012.

*Primary Examiner* — Stephen Meier
*Assistant Examiner* — Alexander D Shenderov
(74) *Attorney, Agent, or Firm* — Bachman & LaPointe, PC

(57) ABSTRACT

An ink cartridge (1) for inserting into an inkjet printer, with an outer housing (2) and an ink container (4) located inside, wherein the ink contained comprises an ink outlet piece (5) through which the ink container (4) can be contacted from the outside in a fluid-conductive manner, wherein on the outer housing (2) of the ink cartridge (1) guiding means (136) are provided in order to align the outer housing (2) on inserting the ink cartridge (1) in the inkjet printer relative to puncturing means, arranged in the inkjet printer in a fixed location, the outer housing (2) of the ink cartridge (1) at least for the greatest part is of a cellulose material and the guiding means are formed as a component that is separate from the outer housing (2) and fixed to the latter, and the component comprises a material that differs from the material of the outer housing.

25 Claims, 6 Drawing Sheets

(56) References Cited

U.S. PATENT DOCUMENTS 7,488,059 B1 * 2/2009 Holland et al. ..... 347/85
2005/0151813 A1 7/2005 Ikezaki et al.
2006/0038865 A1 2/2006 Nagasaki et al.

* cited by examiner

INK CARTRIDGE FOR INKJET PRINTERS

BACKGROUND OF THE INVENTION

The invention relates to an ink cartridge for inkjet printers, having an outer housing and an ink container located inside, in particular an ink bag, which comprises an ink outlet piece through which the ink container can be contacted from the outside in a fluid-conductive manner.

From U.S. Pat. No. 5,666,146 an ink cartridge for the self-aligning insertion in a printer is known. Said ink cartridge comprises an outer housing, which in practice is produced from plastic, in which an ink bag is provided, the flexible outer walls of which are formed by aluminium or nylon film. The ink bag can be contacted in a fluid-conductive manner from the printer through an ink outlet piece by way of interface means or puncturing means belonging to the printer. To this end, a puncturing needle of the interface means of the printer punctures the ink outlet piece when the ink cartridge is inserted in the printer. On a front wall of the outer housing, guide openings are provided, which serve for receiving guide extensions on the printer side. These guide openings interact with the extensions on the printer side such that when the cartridge is inserted in the printer, the cartridge first contacts the extensions on the printer side and is brought in position through these. Following this, the puncturing needle punctures the ink outlet piece in a defined position. When the cartridge punctures the printer the guiding function of the guide openings is ensured through the extensions on the printer side abutting the inner circumference of the guide openings or through the resultant backpressure. This is achieved in that the diameter of the extensions on the printer approximately corresponds to the diameter of the guide openings. Furthermore, a support plate is provided on the ink bag which serves to stiffen the ink bag on a bag side. On the support plate, a filling level indicator is provided, which as soon as the ink bag is (almost) empty of ink, protrudes through a recess in the outer housing. In this case, the filling level indicator can exert pressure on a switch (attached outside the ink cartridge) in the printer, as a result of which on the printer side a low ink filling level in the cartridge can be detected.

A similar ink cartridge is described in DE 692 14 512 T2 (EP 016 088 B1). The ink cartridge described there is characterized in that the ink outlet piece is designed circular in cross section and in that in the ink outlet piece a circular groove is formed, which is positively connected to the outer housing such that the ink outlet piece is held and positioned in a predetermined position relative to the housing. In the outer housing, a semi-circular notch is provided for receiving the groove of the ink outlet piece.

In U.S. Pat. No. 6,053,606 an ink cartridge is disclosed, in which the support plate comprises portions projecting away in a co-planar manner, through which the support plate supports itself on the outer housing. On emptying the ink cartridge, the portions projecting away in a co-planar manner rub along the inside of the outer housing.

Especially in recent times, more value is attached to an environmentally friendly use of resources. The plastic cartridges of the prior art however can only be disposed in an environmentally friendly manner with much effort. In addition, plastic requires mineral oil, a raw material which is becoming increasingly valuable.

From U.S. Pat. No. 7,488,059 B1 a so-called "bulk ink system" is known, in which an ink reservoir arranged outside the printer supplies an ink cartridge (provided in addition to the ink reservoir) arranged in the printer by means of an ink feed line. The guiding means-free housing of the ink reservoir in this case can be of cardboard or plastic. In contrast with the commercially available plastic ink cartridge, no centring of the freely positionable ink reservoir is necessary.

From DE 44 25 694 A1 a further such "bulk ink system" is also known, wherein the guiding means-free housing of the freely positionable ink reservoir is of cardboard. The ink cartridge which is connected to the ink reservoir via an ink line is a moulding, usually of a half plastic, which is adapted to the shape of the cartridge receiving region of the printer.

From US 2005/0151813 A1 a printing frame, in particular for the printing of T-shirts is known, in which a multiplicity of freely positionable and guiding means-free ink reservoirs are placed onto a frame. The ink reservoirs are connected to the printing head via flexible hoses, which are to ensure that they can be freely positioned.

It is thus altogether known with ink reservoirs, which are connected by way of locally flexible hoses, to also produce the outer housing from a cellulose material such as cardboard or pasteboard. In the cases in which the ink reservoir supplies an ink cartridge positioned in the printer these are commercially available plastic cartridges. In contrast with the previously described freely positionable ink reservoirs provided in addition to the ink cartridges, ink cartridges comprise guiding means in order to align or to centre the ink cartridge relative to the fixed-location puncturing or interface means in the printer when being pushed in. For this purpose, the interface means can comprise counter-guiding means, wherein these guide the ink cartridge into a desired position through a counter-force on the guiding means when the ink cartridge is inserted.

SUMMARY OF THE INVENTION

Starting out from the shown prior art, the invention is based on the object of improving an ink cartridge for the direct insertion in an inkjet printer so that it is ecologically more compatible and can in the long term be produced economically at stable prices.

The object is solved by means of an ink cartridge having the features disclosed herein. Advantageous further developments of the invention are also described.

The ink cartridge of the present invention makes possible, compared with the prior art, a particularly environmentally friendly design which is safe for the future. This is achieved in that cellulose material is used as main material for the outer housing, in particular, at least four, preferably six lateral surfaces of the outer housing consist of cellulose material. Because of this, an environmentally compatible production and an environmentally friendly disposal become possible. Cellulose material, i.e. the chemical digestion of plant fibres, is produced from naturally renewable raw materials, can be favourably recycled and consists itself mostly of recycled material.

If in the printer interface means and/or puncturing means are provided, with which through means that are fixed in position (in the printer) for example a puncturing needle, an ink-conductive connection is established, both the position of the cartridge relative to the interface puncturing means in the utilisable state as well as the position movement during the insertion has to be within a defined framework so that the ink cartridge is aligned or centred and a puncturing needle for example punctures the ink outlet piece of the ink cartridge and not next to the latter in an undefined manner. For this reason, mouldings which are unitarily formed with the housing are used with popular plastic ink cartridges from the prior art.

Through the configuration of the outer shell of a cellulose material according to the invention, the ink cartridge in principle is not suitable for use with interface means or self-aligning insertion since the shaping necessary for centring cannot be easily achieved. In addition, a paper and/or cardboard material is/are not sufficiently stable or hard for the guiding function. It is therefore provided according to the invention that guiding means, in particular a guide arm, are provided on the outer shell of the ink cartridge, so that the ink cartridge aligns itself relative to the ink port when being inserted in the printer. These guiding means are preferably of a material (or material mixture or material combination), which has a greater stability than the material of the outer shell, wherein as greater stability a greater stiffness (preferably measured through the modulus of elasticity and/or the shear modulus), a greater strength (in particular compressive strength) and/or a greater hardness (preferably measured according to Shore, Mohs, Martens, Brinell and/or Rockwell) of the material has to be considered, in particular, the material comprises or consists of plastic, metal and/or wood. These materials have the stability necessary for the alignment, so that in particular in the case of an insertion in the printer which is offset with respect to the desired position, the active forces can be favourably absorbed without any plastic deformation occurring.

Preferentially, the guiding means comprise a guide arm which laterally protrudes from a longitudinal side wall of the cartridge. This guide arm is designed so that it can guide the ink cartridge in the printer by means of a guide, in particular a guide rail which longitudinally extends in a desired insertion direction. For stability reasons, it is preferentially of a material, a material alloy and/or a multi-layer construction, e.g. laminate, in particular with a support layer, comprising or consisting of plastic, metal and/or wood.

Preferentially, the guide arm is designed as an angular element, wherein a leg projects through a recess of the longitudinal side wall of the ink cartridge, which can then be contacted by the printer on its part located outside the outer housing. In the case of an L-shaped angle, a second leg of the angle is fixed on an inner wall of the ink cartridge, preferentially glued to the latter. Also conceivable is configuring the guide arms as a T-shaped angle, as a result of which the guide arm can be fixed on a further surface of the outer housing. Through the configuration as angular element, the loadability of the guide arm can be increased, since the forces acting on the guide arm from the outside can be partially absorbed.

In the case of a two-piece embodiment of the ink cartridge, the guide arm is to be preferably provided on the lower part and fixed there. In the upper part, a recess for the guide pin is to be preferably provided in this case.

For a simple design embodiment, this recess does not have to be adapted to the guide arm in an accurately fitting manner but it can be clearly wider than said guide arm and in particular extend as far as to the bottom of the ink cartridge.

Additionally or alternatively the guide arm described above, the guiding means can comprise an axial extension and/or a depression of a suitable material, in particular plastic, metal and/or wood.

In addition to the lateral surfaces of cellulose material, rails or trusses that may be provided can be provided of other materials, in particular for forming the edges. However, the outer housing should be at least for the greatest part be of cellulose material, i.e. the area component of cellulose material on the inner and outer surfaces of the outer housing should be at least 80 percent, preferably at least 95 percent.

Particularly preferably, the outer housing is formed by pasteboard or cardboard, wherein pasteboard describes a material substantially of cellulose material with a grammage below 600 g/m$^2$ and cardboard is a material substantially comprising cellulose material with a grammage of over 600 g/m$^2$.

One or multi-ply corrugated board has proved to be particularly suitable as material for the outer housing. Here, the type of corrugation of the corrugated board is preferably a micro-corrugation having a corrugation pitch between 3.0 mm and 3.5 mm and a corrugation height between 1.0 mm and 1.8 mm. These values offer a sound compromise of stability and space requirement.

Preferably, the ink cartridge is constructed in a cuboid manner and comprises side walls, more specifically a front wall, a back wall, two longitudinal side walls as well as a bottom and a lid, wherein the longitudinal extension of the ink cartridge is designed larger than the width extension and the width extension is designed larger than the height extension.

The longitudinal extension of the ink cartridge preferably is between 40 cm and 60 cm, in particular between 45 cm and 55 cm, its width extension is preferably between 9 cm and 11 cm and its height extension is preferably between 2 cm and 3 cm.

A two-piece embodiment of the outer housing is advantageous. In this case, the ink cartridge comprises an upper part and a lower part which are designed so that they can be inserted into each other and together form the outer housing of the ink cartridge. The upper part comprises the lid and side wall layers. The lower part comprises the bottom and side wall layers. Assembled, the side wall layers of the lower part are located within the side wall layers of the upper part. They jointly form the side walls of the ink cartridge, which because of this are at least in portions formed in a double-walled (or double-layered) manner in the overlap region of upper and lower part. The lid of the upper part supports itself on the edges of the side wall layers of the lower part. Equally, the bottom of the lower part supports itself on the edges of the side wall layers of the upper part.

Between the upper and lower part is located an ink container, which can be preferentially contacted by an ink outlet piece from outside of the ink cartridge in a fluid-conductive manner. To this end, puncturing means on the printer side preferably puncture the ink outlet piece and form a fluid channel from the interior of the ink container to the ink nozzles of the printing head. Through the two-piece embodiment of the ink cartridge, the assembly, in particular with respect to the ink container located in the outer housing, is clearly simplified. With a one-piece embodiment, the outer housing would have to be moulded about the ink container and fastened in a complicated manner, which would also significantly hamper the replacement of the ink container in the ink cartridge.

It has proved to be advantageous to provide a recess in the front wall of the ink cartridge, through which the ink outlet piece is located to the outside. Preferably, the ink outlet piece projects beyond the front wall of the ink cartridge.

Additionally or alternatively to the positive connection means formed by the front wall, positive connection means can be provided between the front wall and the ink container, which space the ink container from the front wall, as a result of which a buckling zone is formed between front wall and ink container, which in particular when the ink cartridge is inserted in the printer, forms a further safety against damages, in particular of the ink container. Preferably, the positive connection means space the ink container from the front wall of the outer housing by at least 0.5 cm. Furthermore, the positive connection means guarantee a secure seat of the ink container in the ink cartridge.

Advantageously, at least one groove is provided in the ink outlet piece, which at least in portions encloses the front wall of the ink cartridge in its thickness so that displacement of the ink container in longitudinal direction is prevented in that the lateral surfaces of the groove absorb the forces acting in longitudinal direction.

In the prior art, for example in EP 016 088 B1, the ink outlet piece is circular in cross section. However, an anti-rotation protection of the ink container with respect to the housing can be created in a simple manner if both the cross section of the ink outlet piece recess as well as the cross section of the ink outlet piece are substantially rectangular, which is therefore preferred.

It has proved to be advantageous, furthermore, to provide a rising (guide) flank from the direction of the front wall towards the back wall on a longitudinal side wall, in particular in that the height extension of the longitudinal side wall decreases towards the side wall. This flank can serve as a guiding mechanism during insertion in a printer. In particular, a counterpart to this flank is provided in the printer, as a result of which it is prevented that the ink cartridge can be inserted wrongly aligned in the printer. This cannot happen since the flank does not exist on the other edges of the ink cartridge and insertion is thus prevented through the counterpart on the printer side.

Adapted to the rising flank it is advantageous to provide a recess in the bottom in addition to said flank, which extends in the lateral edge in transverse direction, i.e. that wherever the longitudinal side wall does not have the maximum height extension, the bottom starting at the flank has a gap with a fixed width. Through this further recess, the counterpart in the printer can also be formed correspondingly wider, as a result of which a wrongly aligned insertion can be even more effectively prevented since a larger counterpart surface is available.

Furthermore, the lid and/or the bottom of the ink cartridge can be preferably provided with an additional reinforcing layer, in particular likewise of cellulose material, preferably of single-corrugation corrugated board, wherein the reinforcing layer is glued, in particular transversely glued to the lid in the interior or the ink cartridge. Preferably, the reinforcing layer in its area is smaller than the inner area of the lid and for example has an edge spacing of 1 to 5 mm, in particular 2 mm from the longitudinal side walls of the ink cartridge. Through the reinforcing layer, the lid or the bottom has a greater load capacity. Such a reinforcing layer is not only conceivable on the lid or bottom but on all surfaces of the ink cartridge.

In order to configure the lid and/or the bottom are particularly capable of taking loads, it has proved to be advantageous to arrange the reinforcing layer so that the corrugations in the cardboard of the reinforcing layer run orthogonally to the corrugations in the cardboard of the lid or of the bottom. Because of this, the lid or the bottom is also stiffened in corrugation direction of the lid or of the bottom.

By providing a reinforcing layer in the interior of the lid, a recess can be provided in the outer cardboard layer—belonging to the cartridge upper part—, wherein the recess however is at least partially covered by the reinforcing layer, i.e. the recess is not identically recessed in its entire area extension in the associated reinforcing layer portion as well. Because of this, an insert for additional components, such as for example RFID-chips or microchips are made available in a portion of the lid, which are then supported by the reinforcing layer or fixed on the reinforcing layer. The reinforcing layer then serves as a kind of support bottom for the component glued thereon, which on its upper side preferably forms a preferably transitionless continuous plane with the cartridge upper part.

Preferably, a further recess is provided in the reinforcing layer, which is designed smaller than the recess in the lid. This makes it possible to let components at least partially project into the interior of the ink cartridge as well. In particular, RFID-chips or microchips, which in their architecture are not entirely plane, can project through this recess.

It has proved to be advantageous to provide a punched-in window in the outer wall of the bottom of the ink cartridge. The punching preferentially does not penetrate the bottom in its entire thickness. A punched-in window has the advantage that it cannot unintentionally detach itself from the ink cartridge. Additionally or alternatively, the outlines of a window can be punched in for the easier and more exact positioning of a glued-on smartcard.

Many printers comprise extensions which serve to guide or adjust ink cartridges, as described for example in the above-mentioned U.S. Pat. No. 5,666,146 on installation in the printer. With the ink cartridge according to the invention, this function is adequately realised through the guide arm. The extensions on the printer side rather result in a more difficult installation and removal because of the additionally generated friction, or in the worst case result in a jamming in the printer, which can only be rectified again with an increased maintenance effort. For this reason it has proved to be advantageous to deliberately omit the guiding function of the extensions on the printer side and for minimal conflicts with existing printers, receive these in the receiving openings in a contactless manner, wherein preferably in the installed state a minimum spacing of 0.2 mm between the extensions on the printer side and the inner surfaces of the receiving openings located opposite is provided. Should, however, a guiding function through the extensions on the printer side be desired, the guiding means can additionally or alternatively to the guide arm comprise means correspondingly interact with the extensions on the printer side. Preferably, however, the guiding means exclusively consist of the guide arm, which preferentially interacts with a rail as counterpart guiding means in the printer extending in insertion direction, wherein the rail on the printer side in its longitudinal extension is preferentially at least as long as the cartridge.

With known plastic cartridges from the prior art, ink bags are usually used, in which a silicone stopper for being penetrated by a puncturing needle on the printer side is provided. This silicone stopper substantially serves for the sealing of a used ink bag both in the punctured state as well as after the puncturing needle has been pulled out. The plastic cartridges are, in particular as injection moulding, formed so that they enclose the silicone stopper with ink bag in position so that the silicone stopper is retained in its position and in particular when pulling out the puncturing needle, is not pulled out as well. In the case of an ink cartridge according to the invention, such a fit on the housing side however can only be achieved in a cumbersome manner. However, in order to nevertheless achieve the corresponding effect, retaining means, for example in the form of a sealing plate, can be provided in a particularly favourable manner on the ink bag, in particular on or in the ink outlet piece, which are designed and arranged so that when the ink cartridge is pulled out of the printer, they can exert a retaining force on sealing means provided on the ink bag in particular in the form of a silicone stopper. Preferably, the retaining means project beyond the sealing means in the direction of the puncturing means on the printer side and protrude over the retaining means cantilever-like at a right angle to the extraction direction of the ink cartridge.

Preferably, the ink container is supported by a support plate. The support plate is produced from rigid material and thus provides the ink container with stability. It is fixed on the ink container, preferably glued to the latter.

The support plate is preferably built substantially flat and extends in longitudinal and width direction of the ink cartridge. Depending on the filling level of the ink container, the height position of the support plate differs relative to the bottom. By gauging the support plate height, a conclusion regarding the ink level in the ink container can be drawn. The ink container is preferably glued to the bottom on the side located opposite the support plate since in this way it is ensured that on emptying, the support plate moves in the direction of the bottom and no spacing for example is created between ink container and bottom (and the support plate remains stationary despite emptying).

Preferably, the support plate in its plane extension does not protrude beyond the ink container. Because of this, contact between support plate and inner wall of the outer housing is avoided, which can result in an unintentional jamming between these and thus in an incorrect conclusion regarding the filling level. In the U.S. Pat. No. 6,053,606 for example emphasis is generally put on the support plate being supported by the outer walls in order to avoid the ink container being damaged. This is deliberately omitted in order to obtain a simpler arrangement and above all in order to avoid friction between the support plate and the cartridge or even a jamming of the support plate.

To better gauge the filling level, a filling lever indicator can be provided on the support plate, which is assigned a recess in the bottom of the ink cartridge. The filling level indicator serves as extension of the support plate in the direction of the recess, as a result of which gauging of the (relative) support plate height can take place outside the ink cartridge. For example, a pressure sensor can be arranged in the printer directly under the recess for the filling level indicator, which through contact can detect the relative filling level height or at least a filling level that is (too) low in a binary manner.

Preferably, the filling level indicator extends obliquely from the support plate and passes around the bag towards the recess in the bottom with no or preferably little surface contact with the outer housing. Alternatively to the oblique design of the filling level indicator, the latter can also extend stepped from the support plate. In this alternative, it extends about the bag towards the recess in the bottom with no or preferably little surface contact with the outer housing.

In order to be able to use the ink cartridge even with a multiplicity of printers it has proved to be advantageous to use the ink cartridge with an adapter. Such an adapter comprises puncturing means on one side, which allow it to puncture the ink container, draw off ink and feeding it to the printing head. On the other side it comprises outlet means which in turn make it possible for puncturing means of a printer to puncture these and to draw off ink in these. Because of this, the puncturing means of the printer do not directly puncture the ink container, so that the ink outlet opening of the ink container does not have to be adapted to the shape of the puncturing means of the printer.

Here, the adapter is preferably fixed on the cartridge and preferably comprises receiving openings for extensions on the printer side as described above in order to make possible easier installation and removal.

Preferably, the ink container is designed as an ink bag with flexible walls.

BRIEF DESCRIPTION OF THE DRAWINGS

Further advantages, features and details of the invention are obtained from the following description of preferred exemplary embodiments as well as by means of the drawings.

These show in.

DETAILED DESCRIPTION

Figure 1:
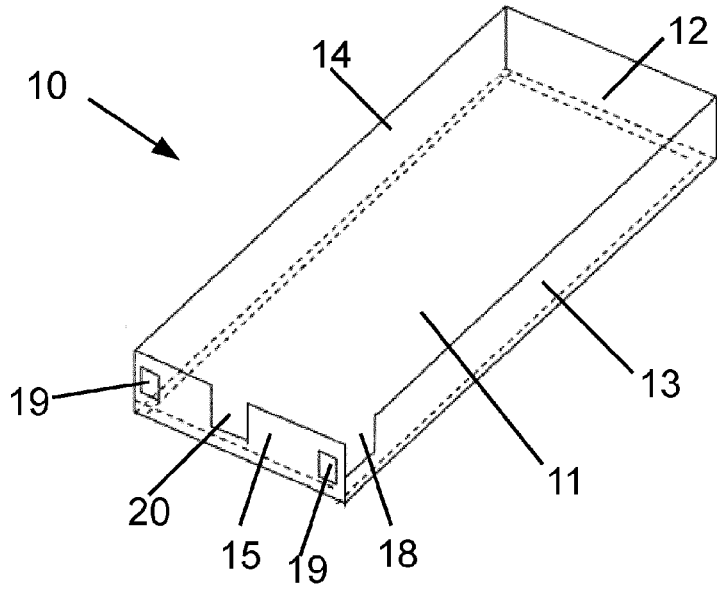
FIG. 1: an upper part of an outer housing of an ink cartridge in a perspective view.

FIG. 1 shows an embodiment of an upper part 10 of an outer housing 2 of an ink cartridge 1 in a perspective view. In this view, the upper part 10 lies on the lid 11. Laterally, the upper part 10 comprises two parallel longitudinal side wall layers 13 and 14. The two longitudinal side wall layers are connected at their ends by a rear wall layer 12 and a front wall layer 15 which is parallel thereto. The rear wall layer 12 and the front wall layer 15 are located opposite each other, the longitudinal side wall layers 13 and 14 are arranged orthogonally to the front wall layer 15 and to the rear wall layer 12 respectively. The lid 11 and the wall layers 12 to 15 of the upper part 10 of the ink cartridge 1 are produced from corrugated board. Altogether, the upper part 10 forms a basin or shell-like geometry.

In the front wall layer 15 of the upper part 10, two spaced rectangular receiving openings 19 are provided. The receiving openings 19 serve to receive extensions on the printer side. The cross section of the receiving openings 19 in each case is larger than the cross section of the extensions on the printer side, as a result of which a contactless receiving of the extensions on the printer side can take place and consequently, on inserting the ink cartridge on the printer, no additional friction through the extensions on the printer side is generated on the ink cartridge, which in turn prevents possible complications such as a jamming of the ink cartridge and/or plastic deformation in particular of the board of the outer housing. In the middle of the front wall layer 15, a rectangular recess 20 for an ink outlet piece is provided. The recess does not extend as far as to the lid 11, but a region filled by corrugated board of the front wall layer 15 is filled out between them. On the side facing away from the lid 11, the recess for the ink outlet piece however extends as far as to the edge, since from this direction the ink outlet piece is placed in the recess and a region filled out with corrugated board of the front wall layer 15 would be in the way of a simple placement.

On the first longitudinal side wall layer, a rectangular recess 18 for guiding means 136 provided on the lower part, here formed by a guide arm 36, is provided, with which the cartridge can be guided in a guide rail in the printer. This recess directly adjoins the front wall layer 15. The recess 18 is continuous on the side facing away from the lid 11, since the guide arm (of the lower part) is received from this direction.

Figure 2:
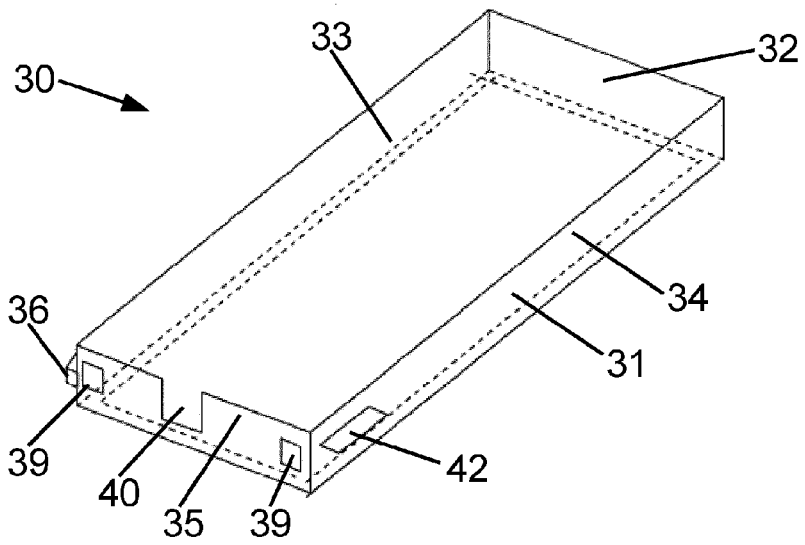
FIG. 2: a lower part of the outer housing of the ink cartridge according to FIG. 1 in a perspective view.

FIG. 2 shows a lower part 30 of the ink cartridge 1 associated with the upper part 10 shown in FIG. 1, likewise in a perspective view. The lower part 30 in this view lies on the bottom 31. In transverse direction (in the direction of the width extension of the cartridge), the lower part 30 is bounded by the two parallel longitudinal side wall layers 33 and 34. In longitudinal direction, the lower part 30 is bounded by the front wall layer 35 and the rear wall layer 32 which is parallel thereto. The bottom 31 and the wall layers 32 to 35 of the lower part 30 of the ink cartridge 1 are produced from corrugated board. Altogether, the lower part 30 likewise forms a basin or shell-like geometry.

On the front wall layer 35 of the lower part 30, two spaced rectangular receiving openings 39 are provided. In the middle of the front wall layer 35 of the lower part 30, a rectangular recess 40 for the ink outlet piece 5 is additionally provided.

On the first longitudinal side wall layer 33, the guiding means in form of the guide arm 36 are attached, which guides the ink cartridge in a guide rail (not shown) on the printer side.

In the bottom 31, a rectangular recess 42 for a filling level indicator (not shown) is provided.

For a better stability of the ink cartridge 1, reinforcing layers are provided in the upper and lower part, which are fixed to upper and lower shell with suitable adhesive means. In the upper part 10, the lid 11 is further strengthened through the reinforcing layer 50. The reinforcing layer 50 is preferentially likewise of corrugated board and has a corrugation direction which is orthogonal to the corrugation direction of the respective portions, to which it is attached.

In order to obtain a complete ink cartridge 1, the lower part from FIG. 1 and the upper part 10 from FIG. 2 are plugged together. To this end, the area of the lid 11 in its longitudinal and width extension is larger than the area of the bottom 31, as a result of which the side wall layers 13 and 14 of the upper part 10 lie outside round about the side wall layers 33 and 34 of the lower part 30. Altogether, two-layered side walls of the ink cartridge 1 are thus formed through the upper part 10 and the lower part 30.

Prior to assembling, an ink container 4 is inserted in the lower part 30. In the process, the ink outlet piece 5 of the ink container 4 is fixed in the recess 40 of the lower part 30. For a better mould, a first groove 6 is provided on the ink outlet piece 5 of the ink container 4. When the upper part 10 is put in place, the ink container 4 is additionally fixed on the ink outlet piece in the recess 20 of the upper part 10. To this end, the groove 6 can be likewise provided which in its width is then adapted to the sum of the thicknesses of front wall layer 35 of the lower part 30 and thickness of the front wall layer 15 of the upper part 10. Alternatively, a second groove 7 can be provided, which is only adapted to the thickness of the front wall layer 15 of the upper part 10. Accordingly, the groove 6 in this case is adapted in its width to the thickness extension of the front wall layer 35 of the lower part 30.

Figure 3:
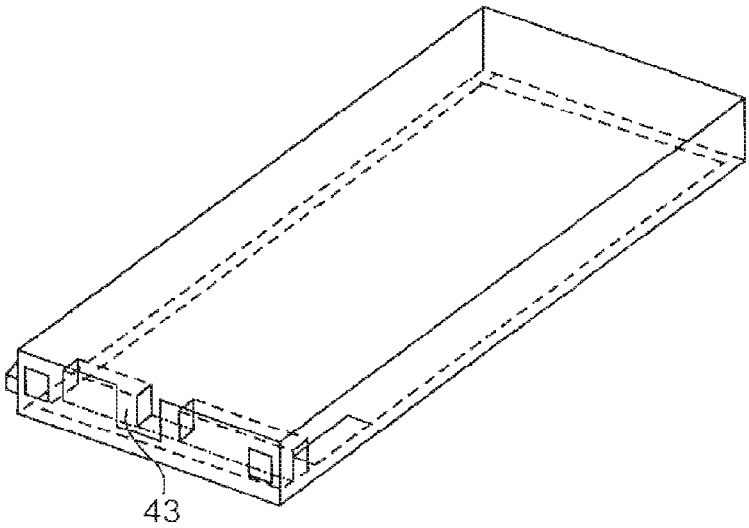
FIG. 3: an ink cartridge with suspensions for bags in the bottom part in a perspective view.

In FIG. 3, the lower part 30 from FIG. 2 is shown with additional positive connection means 43. These positive connection means 43 designed as suspension space the ink container 4 from the front wall layer 35 of the lower part 30. Furthermore, the groove 6 in the ink outlet piece can also support itself against the positive connection means 33 or parts thereof (alternatively or additionally to the front wall of the ink cartridge).

Figure 8A:
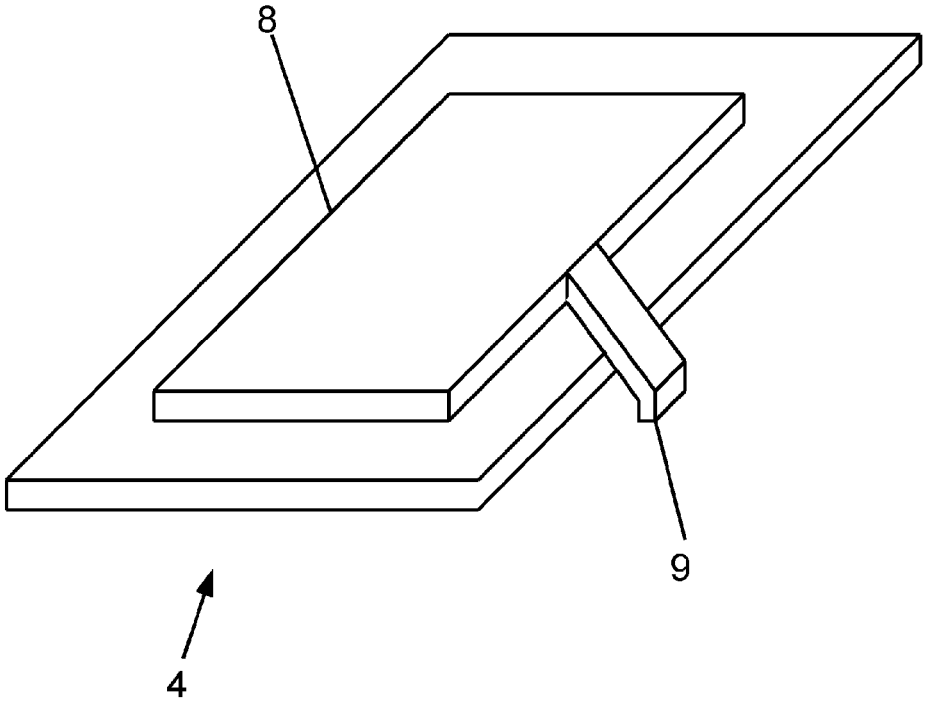
FIG. 8*a*: a schematic representation of a first embodiment of an ink bag with support plate.

As shown in FIG. 8*a*, a support plate 8 is fixed on the ink container 4 in a first embodiment. From the support plate 8, a filling level indicator 9 extends which is run in the direction of the filling level indicator recess 42. The height position of the filling level indicator 9 can be gauged through the filling level indicator recess 42 in the bottom 31 of the lower part 30 from outside of the ink cartridge 1. The filling level indicator 9 extends obliquely from the support plate 8 in the direction of the filling level indicator recess 42 in the bottom 31 of the outer housing 1. The filling level indicator 9 touches the outer housing in a plane that is closer to the bottom 31 than the support plate 8. However, it touches the outer housing only minimally, preferably not at all to prevent complications. The filling level indicator goes around the ink container and ends, depending on the filling level of the ink container, either (within or outside the housing) near the filling level indicator recess 42 or in the latter.

Figure 8B:
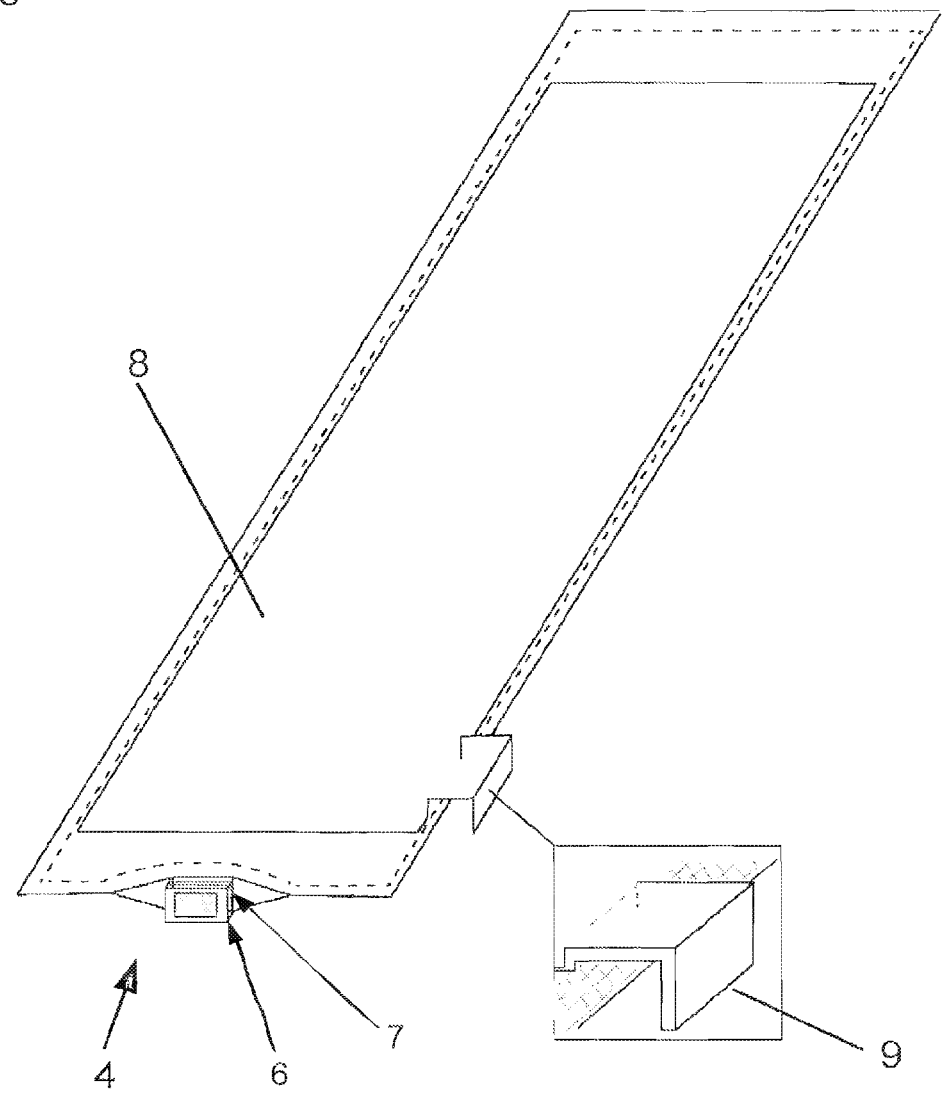
FIG. 8*b*: a schematic representation of a second embodiment of an ink bag with support plate.

FIG. 8*b* shows a second embodiment of an ink container 4, on which a support plate 8 is fixed. From the support plate 8, a filling level indicator first extends in the direction of the lid 11, then runs in a plane that is parallel to the support plate 8 in the direction of a side wall of the outer housing 2 and subsequently in the drawing downwards in the direction of the bottom 31, in particular in the direction of the filling level indicator recess 42. Through the filling level indicator recess, the filling level of the ink container 4 can be gauged from the outside, in particular by a printer.

Figure 4:
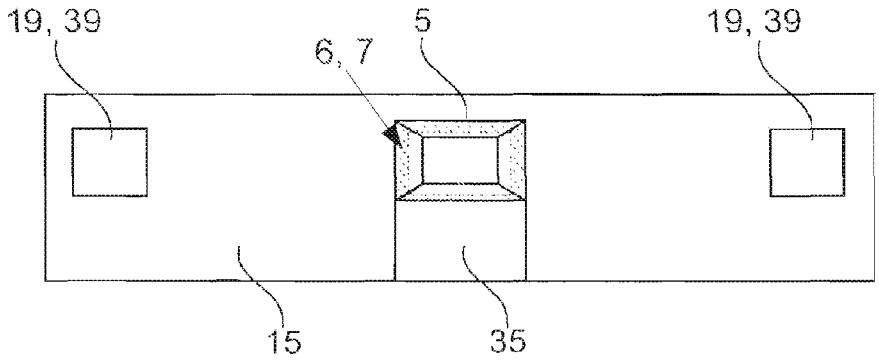
FIG. 4: an ink cartridge with inserted ink bag in a front view.

FIG. 4 shows the front view of an assembled ink cartridge, which comprises the upper part according to FIG. 1, the lower part according to FIG. 2 and an inserted ink container.

Visible is the front wall of the ink cartridge, which comprises the front wall layer 15 of the upper part 10 and the front wall layer 35 of the lower part 30. In the drawing on the left and right, the front wall 15 comprises a rectangular receiving opening 19 each for the contactless receiving of any printer extensions. In the middle of the front wall layer 15 (centred between the receiving openings 19), there is a rectangular recess 20, through which on the one hand the ink outlet piece 5 is exposed towards the outside and on the other hand the front wall layer 35 of the lower part 30 located behind the front wall layer 15 of the upper part is partially exposed towards the outside. The front wall layer 35 of the lower part 30 comprises receiving openings 39, which directly lie behind the receiving openings 19 of the upper part 10. Furthermore, it comprises a recess 40 which on the one hand exposes the ink outlet piece 5 towards the outside and on the other hand exposes a region which is not visible above the ink outlet piece 5 towards the outside.

Figure 5:
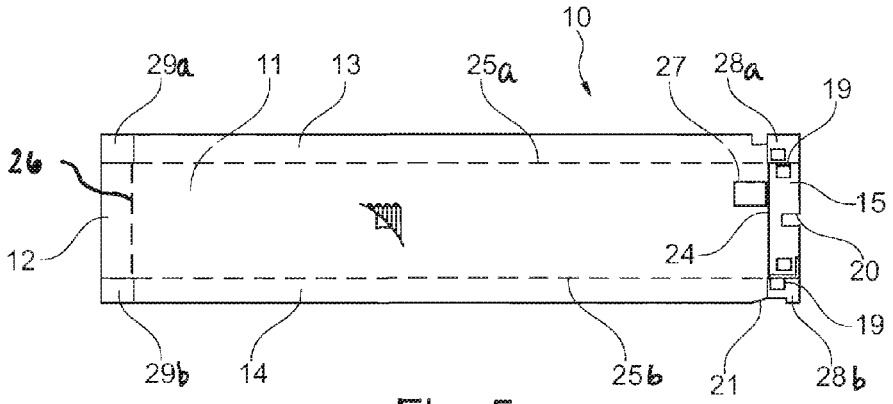
FIG. 5: a profiled cutting for an upper part of the ink cartridge in a top view.
Figure 6:
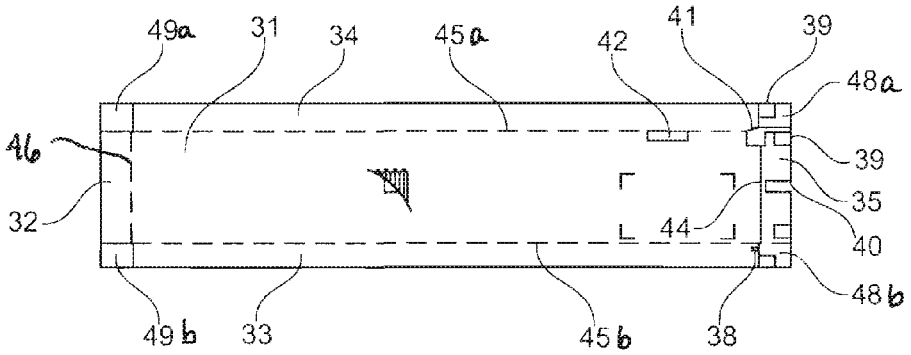
FIG. 6: a profiled cutting for a lower part of the ink cartridge in a top view.
Figure 7:
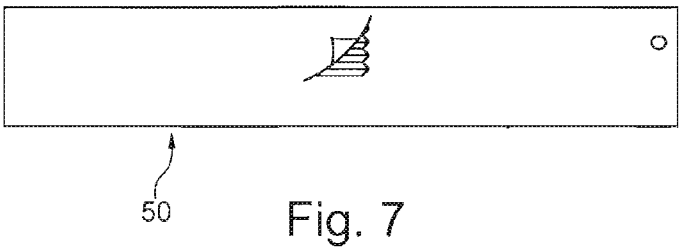
FIG. 7: a profiled cutting for a reinforcing layer for an upper part according to FIG. 5 of the ink cartridge in a top view.

FIGS. 5 to 7 show individual parts of a second embodiment of the invention in a folded-open view. This representation substantially corresponds to the cutting of the individual parts from a flat corrugated board.

FIG. 5 shows a cutting for an upper part 10 of board in the folded-open view. The upper part 10 is produced from a continuous piece of corrugated board, in which the corrugation direction in the Figure runs in horizontal direction.

Centrally in the drawing, the lid 11 is provided, which comprises a recess 27 for an insert part which is not shown. In the drawing plane on the right adjoining the lid 11, a front wall layer 15 is arranged. Between lid 11 and front wall layer 15, a front wall folding edge 24 is provided, on which the front wall layer 15 can be folded relative to the lid 11. On the front wall layer 15, a rectangular ink outlet piece recess 20 and likewise rectangular receiving opening 19 for the contactless receiving of extensions on the printer side are provided.

In the Figure at the top and bottom adjoining the lid 11 are the longitudinal side wall layers 13 and 14, which are separated from the lid 11 through longitudinal side wall folding edges 25*a* and 25*b*, wherein the longitudinal side wall layers 13 and 14 can be folded at the longitudinal side wall folding edges 25*a* and 25*b* relative to the lid 11.

In the Figure left adjoining the lid 11, a rear wall layer 12 is provided, wherein between them a rear wall folding edge 26 is provided, at which the rear wall layer 12 can be folded relative to the lid 11.

The folding edges 24 to 26 can be punched into the corrugated board to facilitate folding over.

Adjoining the front wall layer and the longitudinal side wall layers 13 and 14 are located two front wall gluing regions 28*a* and 28*b*, which are each joined to the longitudinal side wall layers 13 and 14 respectively (foldable/bendable), but are separated from the front wall layer 15 through a recess.

Analogously, adjoining the rear wall layer 12 and the longitudinal side wall layers 13 and 14, two rear wall gluing regions 29*a* and 29*b* are located, which are each joined to the longitudinal side wall layers 13 and 14 respectively (foldable/bendable), but which are separated from the rear wall layer 12 through a recess.

On the outer edge of the second longitudinal side wall layer 14, an oblique guide flank 21 is formed through which the second longitudinal side wall layer 14 narrows towards the front wall layer 15 in its height extension to an inlet height. On the outer edge of the front wall layer 15 and on the lower edge of the second front wall gluing region 28*b*, recesses are provided in each case, through which the front wall layer 15 and the front wall gluing region are narrowed to the inlet height.

On the outer edge of the first longitudinal side wall layer 13 a recess 18 (See also FIG. 1) for a guide arm 36, which is fastened to the lower part 30, is provided.

FIG. 6 shows a cutting for a lower part 30 of board in the folded-open view. The lower part is of a continuous piece of corrugated board, in which the corrugation direction in the Figure runs in horizontal direction.

Centrally in the lower part 30 the bottom 31 is shown. In the Figure on the right, a front wall layer 35 adjoins the bottom 31, which comprises a rectangular ink outlet piece recess 40 and likewise rectangular receiving openings 39 for the contactless receiving of extensions on the printer side. Between bottom 31 and front wall layer 35 a front wall folding edge 44 is provided.

In the Figure at the top and bottom adjoining the lid 31 are located the longitudinal side wall layers 33 and 34, which are separated from the bottom 31 through longitudinal side wall folding edges 45*a* and 45*b*.

In the Figure on the left adjoining the bottom 31, a rear wall layer 32 is provided, wherein between them a rear wall folding edge 46 is provided, through which the rear wall layer 32 can be folded relative to the bottom 31.

The folding edges 44 to 46 can be punched into the corrugated board to facilitate folding over.

Adjoining the front wall layer 35 and the longitudinal side wall layers 33 and 34, two front wall gluing regions 48*a* and 48*b* are located which are each joined to the longitudinal side wall layers 33 and 34 respectively (foldable/bendable), but which are separated from the front wall layer 35 through a recess.

Analogously, adjoining the rear wall layer 32 and the longitudinal side wall layers 33 and 34 are located two rear wall gluing regions 49*a* and 49*b*, which are each joined to the longitudinal side wall layers 33 and 34 respectively (foldable/bendable), but which are separated from the rear wall layer 32 through a recess.

On the edge of the second longitudinal side wall layer 34 facing the bottom 31 near the front wall layer 35 an oblique guide flank 41 is formed, through which the second longitudinal side wall layer 34 in its height extension (vertically in the Figure) narrows towards the front wall layer 15 to an inlet height. On the outer edge of the front wall layer 35 and on the edge of the first front wall gluing region 48*a* facing the front wall layer 35, recesses are each provided, through which the front wall layer 35 and the front wall gluing region 48*a* are narrowed towards the inlet height.

On the first longitudinal side wall layer 33, there is a recess 38 for a guide arm 36 configured as angle (not shown), which following the folding of the lower part 30 is fixed to the latter, wherein a leg is positioned through the recess 38 and at least one other one is fastened to an inner surface of the lower part 30, in particular glued.

FIG. 7 shows a reinforcing layer 50, as are used for reinforcing the upper part shown in FIG. 5. The corrugation direction runs vertically in the Figure and is thus perpendicular to the corrugation direction of the upper part.

In order to get from the folded-out individual parts of the FIGS. 5 to 7 to a complete cartridge, the individual parts are first brought into their three-dimensional final form through folding and gluing.

On the upper part, the longitudinal side wall layers 13 and 14 (including the gluing regions 28*a*/28*b* and 29*a*/29*b* connected to these), the front wall layer 15 and the rear wall layer 12 are folded upwards at the respective folding edges 24 to 26 in the Figure plane.

The front wall gluing regions 28*b* and 28*b* are now arranged so that they abut the front wall layer 15 in a contacting manner. The front wall gluing regions 28*a* and 28*b* are subsequently glued to the front wall layer 15 through suitable adhesive means.

The rear wall gluing regions 29*a* and 29*b* are arranged so that they abut the rear wall in a contacting manner and can be glued to the rear wall layer.

The final form, the longitudinal side wall layers 13 and 14, the front wall layer 15 and the rear wall layer 12 are each at a right angle to the plane extension of the lid 11 in their plane extension, wherein the longitudinal side wall layers 13 and 14 are parallel to each other and the front wall layer 15 and the rear wall layer 12 are parallel to each other.

Either before or after the folding and gluing, the reinforcing layer 50 is fixed to the lid 11. Additionally or alternatively, a reinforcing layer can be provided on the bottom 31 analogously to the lid 11.

On the lower part, the longitudinal side walls 33 and 34 (including the gluing regions 48*a*/48*b* and 49*a*/49*b* connected to these), the front wall 35 and the rear wall 32 are first folded upwards at the respective folding edges 44 to 46 in the Figure plane.

The front wall gluing regions 48*a* and 48*b* are now arranged so that they abut the front wall layer 35 in a contacting manner. They are subsequently glued to the front wall layer 35 through a suitable adhesive means.

The rear wall gluing regions 49*a* and 49*b* are arranged so that they abut the rear wall layer in a contacting manner and can be glued to the rear wall.

In the final form, the longitudinal side wall layers 33 and 34, the front wall layer 35 and the rear wall layer 32 are each at a right angle to the plane extension of the bottom 31 in their plane extension, wherein the longitudinal side wall layers 33 and 34 are parallel to each other and the front wall layer 35 and the rear wall layer 32 are parallel to each other.

According to the first embodiment, an ink container is placed in the lower part and fixed if required, and upper part and lower part subsequently plugged together.

On inserting in a printer, the cartridge is guided into its desired position through two mechanisms. On the one hand, the guide arm is located on the first longitudinal side wall, which interacts with a guide on the printer side and brings the ink cartridge in position. On the other hand, the guide flank 21 and 41 serves as a further correction means.

Figure 9:
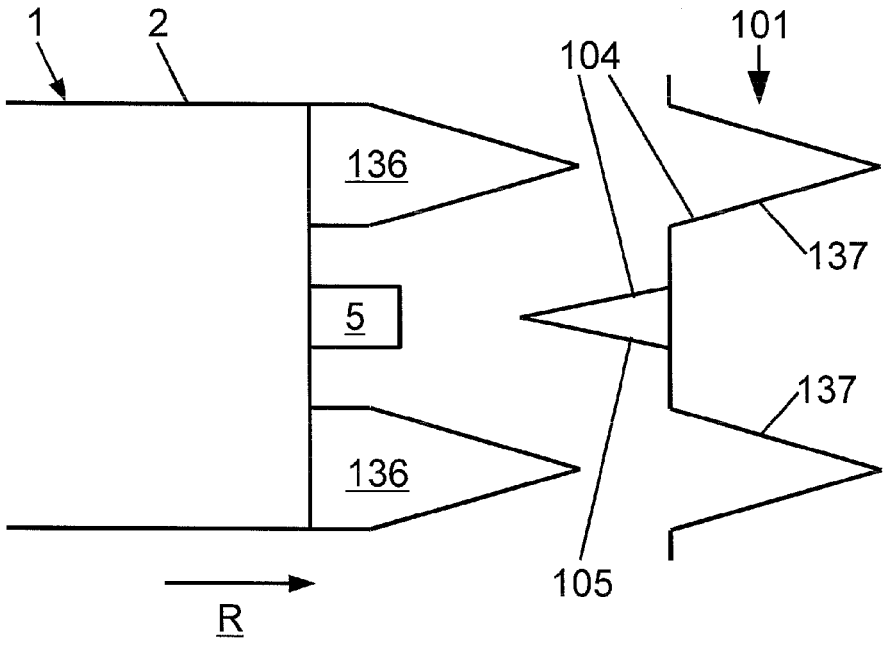
FIG. 9: a schematic sectional view of an exemplary embodiment of an ink cartridge with moulding means.

FIG. 9 shows a detail of a further exemplary embodiment of an ink cartridge 1 according to the invention together with a detail of an inkjet printer 101, wherein the ink cartridge comprises an outer housing 2 of a cellulose material, on which guiding means 136 in the form of an axial extension are attached. Furthermore, the ink cartridge comprises an ink outlet piece 5 which is designed so that it can interact with interface means 104 on the printer side which comprise puncturing means 105 with a puncturing needle, so that an ink-conductive connection between ink cartridge 1 and printer 101 is established.

The guiding means 136 formed as axial extension in this case are produced from a plastic having a greater stability, i.e. a greater stiffness and hardness than the material of the outer housing 2. The axial extension comprises two conical centring means, which on inserting the ink cartridge 1 in the inkjet printer 101, interact in insertion direction R with counter guiding means 137 on the printer side formed as conical depressions so that an ink outlet piece 5 is aligned or centred relative to the puncturing means 105 in the form of a puncturing needle.

The invention claimed is:

1. An ink cartridge (1) for inserting into an inkjet printer, with an outer housing (2) and an ink container (4) located inside, wherein the ink container comprises an ink outlet piece (5) through which the ink container (4) can be contacted from the outside in a fluid-conductive manner, wherein on the outer housing (2) of the ink cartridge (1) guiding means (136) are provided in order to align the outer housing (2) on inserting the ink cartridge (1) in the inkjet printer relative to puncturing means, arranged in the inkjet printer in a fixed location, wherein the outer housing (2) of the ink cartridge (1) has top, bottom and side walls that together form the housing, and at least for the greatest part of the top, bottom and side walls is of a cellulose material and the guiding means are formed as a component that is separate from the outer housing (2) and fixed to the latter, and the component comprises a material that differs from the material of the outer housing.

2. The ink cartridge according to claim 1, wherein the component fixed to the outer housing comprises a cellulose material-free material or material mixture.

3. The ink cartridge according to claim 1, wherein the component fixed to the outer housing comprises wood, metal and/or plastic.

4. The ink cartridge according to claim 1, wherein the component fixed to the outer housing comprises a material having a greater stability than the material of the outer housing.

5. The ink cartridge according to claim 1, wherein the guiding means comprise a guide arm (36), which is formed as a two-legged angular element and projects through a recess in the longitudinal side wall and is fixed to the inside of the longitudinal side wall.

6. The ink cartridge according claim 1, wherein the outer housing (2) comprises a reinforcing layer (50) on an inside of a lid (11) of the outer housing, and/or the outer housing comprises a reinforcing layer on an inside of a bottom (31) of the outer housing.

7. The ink cartridge according to claim 6, wherein a recess (27) for receiving inserted objects of an electronically readable data carrier and/or microchips is provided in the lid (11), wherein the recess, from the inside of the outer housing (2), is at least partially covered by the reinforcing layer (50).

8. The ink cartridge according to claim 6, wherein the reinforcing layer comprises cellulose material.

9. The ink cartridge according to claim 1, wherein the outer housing (2) of the ink cartridge (1) is at least for the greatest part of pasteboard or cardboard.

10. The ink cartridge according to claim 9, wherein the outer housing (2) of the ink cartridge (1) is at least for the greatest part made of single-corrugated and/or multi-corrugated corrugated board.

11. The ink cartridge according to claim 1, wherein the outer housing (2) comprises six lateral surfaces, namely a front wall, a rear wall, a bottom (31), a lid (11) and a first and a second longitudinal side wall, wherein at least four of the lateral surfaces are formed of cellulose material.

12. The ink cartridge according to claim 11, wherein the ink cartridge (1) is constructed of multiple parts and comprises an upper part (10) and a lower part (30), which can be plugged into each other, wherein the lid (11) is formed by the upper part (10), the bottom (30) by the lower part (31) and the front wall, the rear wall and the longitudinal side walls both by upper part (10) as well as by lower part (30).

13. The ink cartridge according to claim 11, wherein an ink outlet piece recess (20) is provided in the front wall, in which the ink outlet piece (5) in the ink cartridge (1) is fixed, wherein the ink outlet piece (5) comprises at least one groove (6), which is positively fixed to the ink outlet piece recess, and/or wherein, spaced from the front wall in the interior of the outer housing (2), positive connection means (44) with an ink outlet piece recess are provided, on which the ink outlet piece is positively fixed with at least one groove (6).

14. The ink cartridge according to claim 11, wherein ink outlet piece (5) and/or the ink outlet piece recess (20) of the front wall and/or the ink outlet piece recess of the positive connection means (43) is/are rectangular in cross section.

15. The ink cartridge according to claim 11, wherein at least one longitudinal side wall on a longitudinal edge comprises an oblique guide flank (21), so that the height extension of the longitudinal side wall decreases towards the front wall, and wherein, in an adjoining lateral surface, a recess is provided, which in its longitudinal extension corresponds to the longitudinal extension of the guide flank (21) and which adjoins the guide flank (21).

16. The ink cartridge according to claim 11, wherein in the front side, receiving openings (19 and 39) for contactless receiving of extensions on the printer side are provided.

17. The ink cartridge according to claim 11, wherein a support plate (8) is provided, which extends in a plane that is parallel to the bottom (31) and which is fixed on a filled ink container, wherein the support plate (8) in its plane does not protrude over the ink container (4) in any location.

18. The ink cartridge according to claim 17, wherein, from the support plate (8) a filling level indicator (9) for interaction with a filling level switch protrudes in the direction of the bottom (31) of the ink cartridge (1) and wherein, in the bottom (31) of the ink cartridge (1), a recess (42) for the filling level indicator is provided.

19. The ink cartridge according to claim 18, wherein the filling level switch is a pressure switch of the printer.

20. The ink cartridge according to claim 11, wherein the outer housing is a cuboid form, and wherein six lateral surfaces of the cuboid form are made of cellulose material.

21. The ink cartridge according to claim 1, wherein on the ink outlet piece (5), sealing means of a silicone compound are provided and wherein, on the ink outlet piece (5), retaining means are provided which are arranged and designed so that when the ink cartridge (1) is pulled out of the printer (101), these exert a retaining force on the sealing means wherein the retaining means are preferably formed of a material other than that of the outer housing of the ink cartridge.

22. The ink cartridge according to claim 21, wherein the retaining means are formed of a cellulose material-free material or material mixture.

23. A system of an ink cartridge (1) according to claim 1, and an adapter, which comprises puncturing means for puncturing an ink container (4) and an outlet region for receiving puncturing means.

24. An inkjet printer (101) with an ink cartridge (1) claim 1, wherein the inkjet printer (101) comprises counter guiding means (137) and wherein the guiding means (136) of the cartridge are designed and arranged so that on inserting the ink cartridge (1) in the inkjet printer (101) in an insertion direction (R) through interaction with the counter guiding means (137), align the ink cartridge (101) so that at least in portions a positive connection between the ink outlet piece (5) and the interface means (104) is created.

25. The inkjet printer (101) with an ink cartridge (1) according to claim 24, wherein the counter guiding means (137) comprise a guide rail longitudinally extending in insertion direction (R), which are as long as the cartridge in its longitudinal extension.

* * * * *